US006327885B1

(12) United States Patent
Marsoun et al.

(10) Patent No.: US 6,327,885 B1
(45) Date of Patent: Dec. 11, 2001

(54) ROLLING-MILL INSTALLATION

(75) Inventors: Dietmar Marsoun, Traun; Wolfgang Horst Hölbling, Bruck/Mur, both of (AT)

(73) Assignee: Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/625,685

(22) Filed: Jul. 26, 2000

(30) Foreign Application Priority Data

Jul. 26, 1999 (AT) ..... 1295/99

(51) Int. Cl.[7] ..... B21B 41/04

(52) U.S. Cl. ..... 72/228; 72/201; 72/230; 72/231; 72/250

(58) Field of Search ..... 72/226, 227, 228, 72/230, 231, 277, 201, 206, 250

(56) References Cited

U.S. PATENT DOCUMENTS

| | | | | |
|---|---|---|---|---|
| 5,345,805 | * | 9/1994 | Hauck | 72/230 |
| 5,715,720 | | 2/1998 | Balve et al. . | |
| 5,893,288 | * | 4/1999 | Shore | 72/228 |
| 5,946,783 | * | 9/1999 | Plociennik et al. | 72/228 |
| 6,105,412 | * | 8/2000 | Muller | 72/228 |
| 6,161,411 | * | 12/2000 | Bocking | 72/227 |

FOREIGN PATENT DOCUMENTS

| | | | | |
|---|---|---|---|---|
| 19843032 | * | 9/1998 | (DE) | 72/228 |
| 0264868 | | 4/1988 | (EP) . | |
| 0560115 | | 9/1993 | (EP) . | |
| 0571789 | | 12/1993 | (EP) . | |
| 0732159A2 | | 9/1996 | (EP) . | |
| 0606966 | | 9/1997 | (EP) . | |

* cited by examiner

*Primary Examiner*—Ed Tolan
(74) *Attorney, Agent, or Firm*—Ostrolenk, Faber, Gerb & Soffen, LLP

(57) ABSTRACT

In a rolling-mill installation for the continuous production of fine steel includes a roughing block, a finishing block arranged on the rolling line of and after the roughing block, a water cooling section arranged after the finishing block and on the rolling line and a laying unit arranged downstream. In order optionally to be able to carry out rolling processes in accordance with conventional rolling or thermomechanical rolling, the finishing block arranged on the rolling line of the roughing block can be moved into a rolling position at a distance from the rolling line of the roughing block and back again. A rolled-material diverter is arranged downstream of the water cooling section by which the rolled material can optionally be routed on the one hand to a laying unit and on the other hand, via a soaking section, to the finishing block which has been moved at a distance from the rolling line of the roughing block.

16 Claims, 2 Drawing Sheets

ROLLING-MILL INSTALLATION

BACKGROUND OF THE INVENTION

The invention relates to a rolling-mill installation for the continuous production of fine steel, especially wire, having roughing block, a finishing block arranged on the rolling line of the roughing block, a water cooling section arranged next and on the rolling line, and a laying unit arranged downstream.

Rolling-mill installations of this type are used for the conventional rolling of fine steel, especially of wire. In an installation of this type, for example one disclosed by EP B1 0 606 966, various paths, in which different rolling stands are arranged, can be passed through, depending on the desired final cross section of the rolled product and depending on the necessary final rolling temperature for the rolled material. The different paths are put into or out of operation by change-over devices for the rolled material—these are diverter-like components—, the rolled material on the one hand tracing relatively long or on the other hand tracing relatively short paths through the entire rolling-mill installation.

In recent times, the aim has been to achieve specific advantageous structure in the rolled material and therefore improved mechanical properties of the rolled material, which is implemented by means of thermomechanical rolling. In this case, following intensive surface cooling, the rolled material passes through a soaking section, in which far-reaching equalization of the temperature of the surface of the rolled material with the temperature of the core is carried out, so that for the subsequent deformation there is a largely homogenous temperature field within the cross section of the rolled material. Rolling-mill installations in which thermomechanical rolling is possible are disclosed, for example, by EP B1 0 264 868 and EP B1 0 560 115.

The drawback with installations of this type is, on the one hand, an extremely short soaking section, which does not permit adequate temperature equalization between core and surface, as a result of which thermomechanical rolling over the entire cross section cannot be achieved. On the other hand, adequate temperature equalization requires very long soaking sections, which in turn result in an extremely long design of the overall installation. In order to avoid these drawbacks, the rolled material has been led in a loop after emerging from the water cooling section and, after passing through the loop, has been finished in the finishing stand. An installation of this type is disclosed, for example, by EP B1 0 571 789. However, the drawback with an installation of this type is that during the rolling of small finished dimensions, as a result of the high number of passes, the reheating of the previously cooled material does not permit thermomechanical rolling.

SUMMARY OF THE INVENTION

The invention is set the following specific task: using an only slightly modified conventional rolling-mill installation for the continuous production of fine steel (the installation being build for conventional rolling) it is also to be possible to carry out thermomechanical rolling of the fine steel, especially of wire, and in particular as an option. In order to implement this, as mentioned, only slight conversion work on the conventional rolling-mill installation is to be necessary. In particular, thermomechanical rolling is to be possible with the same overall length of the original rolling-mill installation, so that no additional space is required in the longitudinal direction of the installation, and therefore no lengthening of the machine hall is to be required either.

According to the invention, this object is achieved in that the finishing block arranged on the rolling line of the roughing block can be moved into a rolling position at a distance from the rolling line of the roughing block and back again, and in that downstream of the water cooling section there is arranged a rolled-material diverter with which the rolled material can optionally be routed on the one hand in the direction of the laying unit and on the other hand, via a soaking section, to the finishing block moved at a distance from the rolling line of the roughing block.

EP 0 732 159 A2 discloses the practice of arranging a rolling stand with the rolling grooves for its alignment to the roll accessories and the roll centre on a guide frame such that it can be displaced in the direction of the axes of the rolls in the roll stand. In this case, a stationary guide frame bears a bearer for the roll accessories. By means of displacing the rolling stand relative to the bearer, precise alignment of the rolling grooves to the roll accessories can be achieved.

A solution which is simple in design terms is characterized in that the finishing block can be moved out of the rolling line of the roughing block by parallel displacement or movement into a position to one side.

Another solution which is simple to implement is characterized by pivoting the finishing block into a position to one side of the rolling line of the roughing block.

In order to ensure the cooling of the finished fine steel, there is preferably arranged on the rolling line of the finishing block moved to the side of the rolling line of the roughing block a further water cooling section, this further water cooling section being oriented in the direction of the laying unit.

The soaking section can be configured in a particularly space-saving way if it has two approximately semicircular curved parts which are connected by a rectilinear part.

For the satisfactory conveyance of the rolled material to be rolled thermomechanically, it is advantageous to provide at least one driver at the start of the soaking section and one driver close to the end of the soaking section, upstream of the finishing block, it being expedient for a total of three drivers to be provided, specifically one at the start of the soaking section in the area of the rolled-material diverter, a straightening driver at the end of the first semicircular curved part of the soaking section, following the rolled-material diverter, and the third driver at the start of the second semicircular curved part of the soaking section, the said second curved part of the soaking section opening flush with the rolling line of the finishing block arranged to the side of the rolling line of the roughing block.

An embodiment which is favourable in terms of space is characterized in that a main part of the soaking section extends approximately parallel to the water cooling section arranged on the rolling line of the roughing block.

The rolled-material diverter provided to change over from conventional rolling to thermomechanical rolling is characterized, according to a preferred embodiment, in that it can be moved optionally into two positions, specifically into a first position for conventional rolling, in which a guide of the rolled-material diverter is oriented from the rolling line of the roughing block to the laying unit, and into a second position for thermomechanical rolling, in which a first further guide is oriented from the rolling line of the roughing block to the soaking section, and a second further guide is oriented from the finishing block moved at a distance from the rolling line of the roughing block to the laying unit, the first further guide, in plan view, crossing the second further guide, and these guides being offset vertically, at least in the crossing area.

BRIEF DESCRIPTION OF THE DRAWINGS

The invention is explained in more detail below using an exemplary embodiment that is illustrated schematically in the drawing, FIG. 1 showing a plan view of a rolling-mill installation in the state for conventional rolling and FIG. 2 showing a plan view of this rolling-mill installation in the state for thermomechanical rolling.

DESCRIPTION OF PREFERRED EMBODIMENTS

Figure 2:
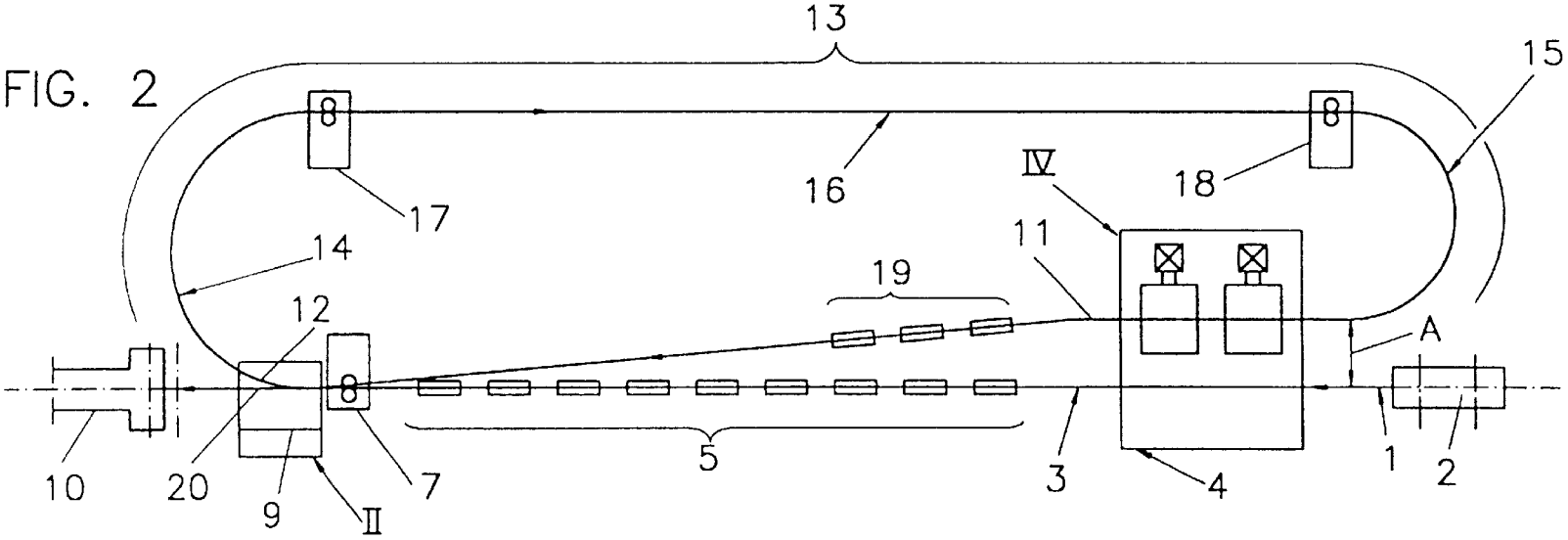

According to the embodiment illustrated in FIG. 1, the rolled material 1 to be finished passes through a roughing block 2, or also referred to as a wire-drawing block, and subsequently passes through the finishing block 4 arranged on the rolling line 3 of the roughing block 2. After leaving the finishing block, the rolled material 1 passes into a water cooling section 5 arranged flush with the rolling line 3 of the roughing block 2, at the end 6 of which water cooling section 5 a driver 7 is provided, although this is inactive during conventional rolling, that is to say that its driving discs are arranged at a distance at which there is no contact with the rolled material 1. Provided downstream of the driver 7 in the rolling direction is a rolled-material diverter 8, which can optionally be moved into two positions I and II, specifically into a first position I for conventional rolling, in which a guide 9 for the rolled material 1 is oriented from the rolling line 3 of the roughing block 2 to a laying unit 10 arranged downstream of the diverter 8 and—as further described later—into a second position II for thermomechanical rolling. When the rolled-material diverter is moved into position I, this guide 9 for the rolled material 1 is thus located flush with the rolling line 3 of the roughing block 2.

Figure 1:
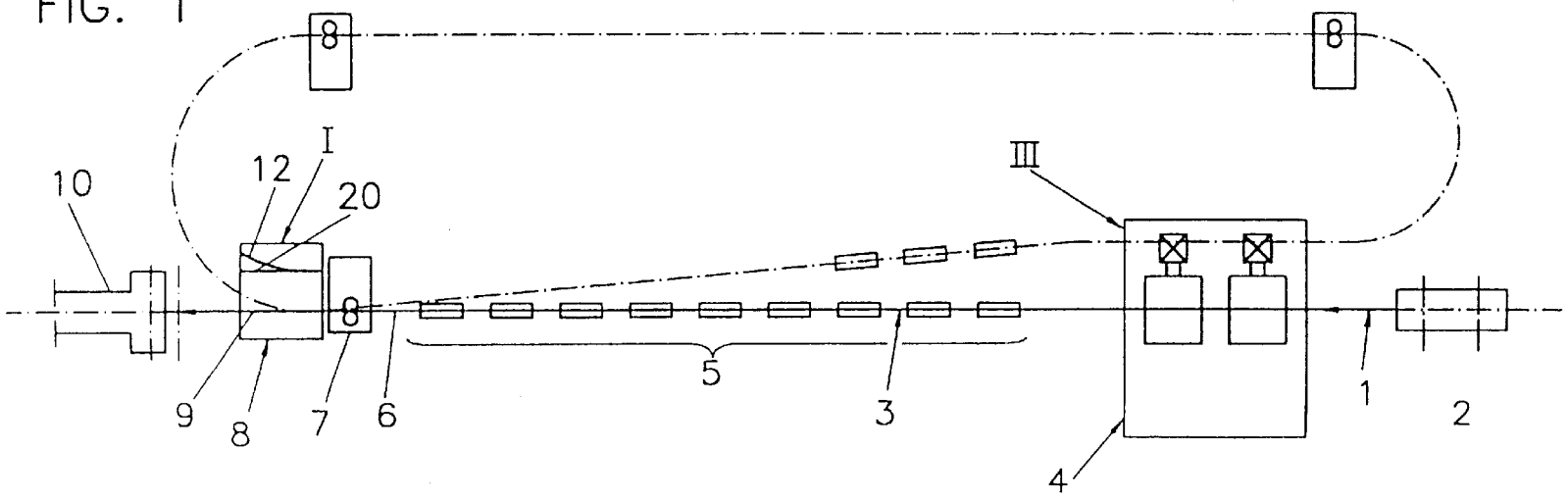
Figure 4:
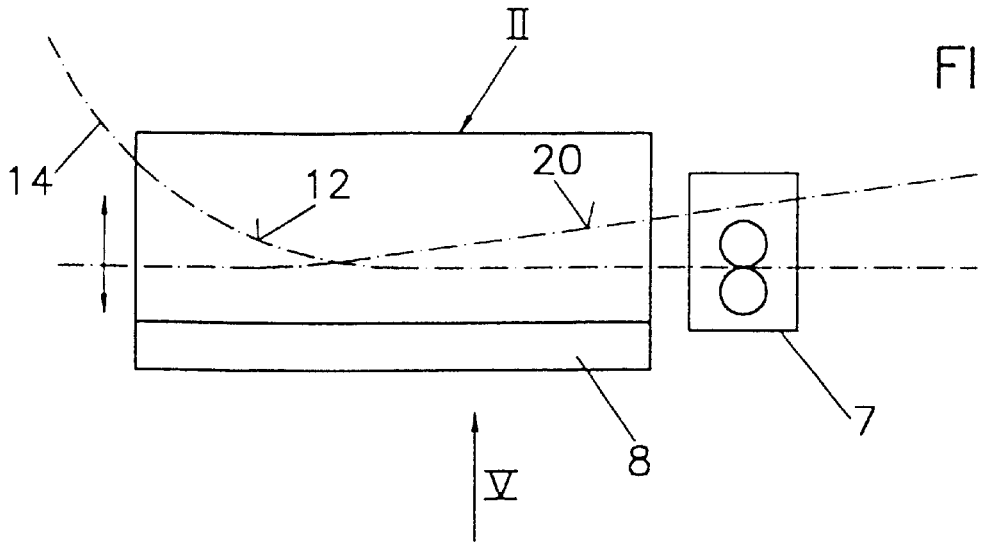
FIGS. 3 and 4 show a detail of FIGS. 1 and 2 on an enlarged scale, FIG. 3 showing the state analogous to FIG. 1 for conventional rolling and FIG. 4 showing the state analogous to FIG. 2 for thermomechanical rolling.
Figure 3:
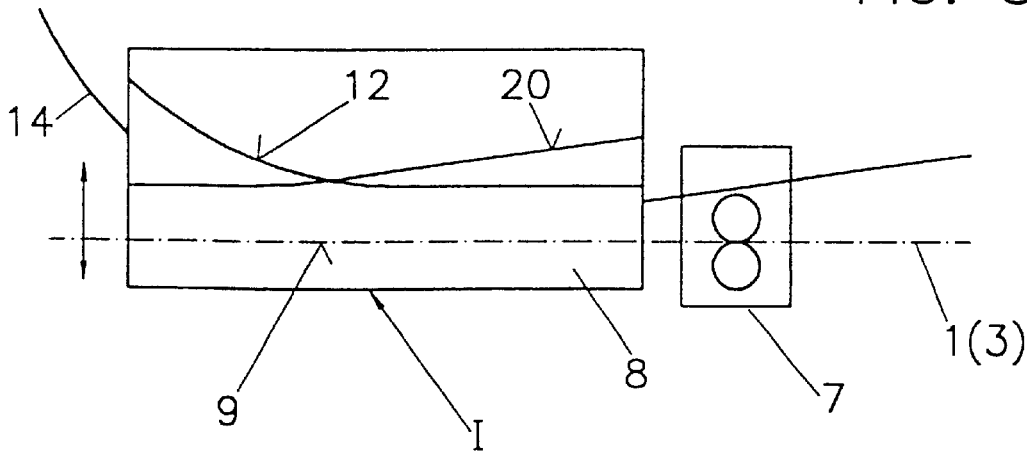

In order also to be able to roll the rolled material 1 thermomechanically in an installation of this type, it is possible for the finishing block to be moved from the position III shown in FIG. 1 into a position IV, in which its rolling line 11 ends up at a distance A from the rolling line 3 of the roughing block 2. In addition, the rolled-material diverter 8 can be moved into a second position II, in which a first further guide 12 of the rolled-material diverter 8 for the rolled material 1 is oriented from the rolling line 3 of the roughing block 2 to a soaking section 13. These positions II and IV are illustrated in FIGS. 2 and 4. The soaking section 13 is formed by two curved parts 14 and 15, which are connected by a rectilinear part 16. Provided at the end of the first curved part 14 is a further driver, which is constructed as a straightening driver 17, which drives the rolled material 1 through the rectilinear part 16 of the soaking section 13 and aligns it straight again. This rectilinear part 16 of the soaking section 13 extends parallel to the rolling line 3 of the roughing block 2, but the rolled material 1 is moved in the opposite direction.

Provided at the end of the rectilinear part 16 of the soaking section 13 is a further driver 18, which leads the rolled material 1 over the adjacent second curved part 15 to the finishing block 4, but this finishing block 4 has been moved into the second position IV, in which the rolling line 11 of the finishing block 4 ends up aligned with the end of the second curved part 15.

Figure 5:
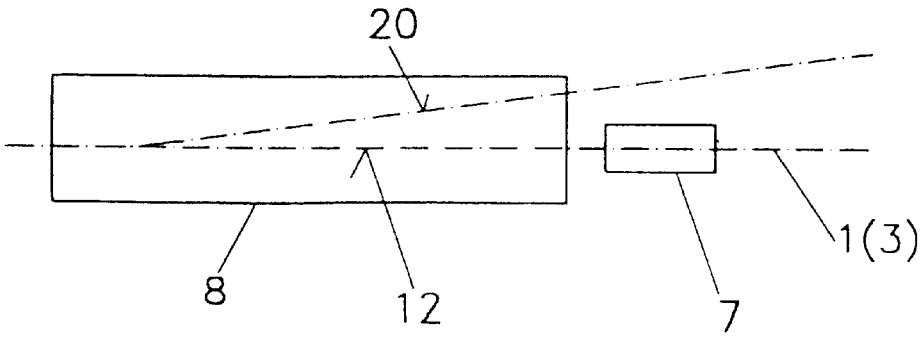
FIG. 5 is a view in the direction of the arrow V in FIG. 4.

The movement of the finishing block 4 can be provided by displacing, moving or pivoting from the position III shown in FIG. 1 for conventional rolling into the position IV shown in FIG. 2 for thermomechanical rolling. Provided following the finishing block 4 is a further water cooling section 19, which accepts the rolled material 1 emerging from the finishing block 4. This further water cooling section 19 is oriented with its longitudinal direction towards the rolled-material diverter 8 or the laying unit 10. In order to guide the finished fine steel 1 or wire satisfactorily, the diverter has a second further guide 20 for the fine steel 1 which, in plan view, crosses the first further guide 12, but leads the rolled material 1 just vertically above the first further guide 12 (cf. FIG. 5).

The invention is not restricted to the exemplary embodiment illustrated, but can be modified from various points of view. Thus, instead of the finishing stand 4, which is illustrated in the drawing as a two-stand block, a second two-stand block can also be provided. With regard to the arrangement of the drivers 7, 17 and 18, those skilled in the art have free reign, since these, that is to say their arrangement and number, depend on the product to be produced.

In principle, only the second driver 17 in the rolling direction also has a straightening function to fulfil, and it ensures that the deformation of the rolled material 1, which it suffers in the first curved part 14, is corrected after it emerges from the curved part 14, in order to ensure a trouble-free passage for the rectilinear part 16 of the soaking section 13. The first and the third driver 7 and 18 do not need to fulfil such a function, since the rolled material 1 is pushed through the circular curved part 14 and 15 of the soaking section 13 by the drivers 7 and 18. These drivers 7 and 18 therefore have driver discs which are advantageously arranged horizontally, that is to say driver discs with vertically arranged axes.

The installation according to the invention can be used to produce fine steel with different dimensions; it is preferably used to produce wire in the diameter range from 5 to 19 mm. However, the equal-area cross section of the fine steel can also be oval, square or else polygonal.

The soaking section 13 is advantageously arranged between the roughing block 2 and the finishing block 4; in principle, it can be provided between any two rolling blocks desired, the rolling block arranged downstream in the rolling direction being designed to be moveable in the sense of the invention, in order to interconnect the soaking section or to render it inactive.

In order to achieve good equalization of the temperature between the core and the surface temperatures of the rolled material 1, the soaking section 3 should be as long as possible. Thus, for example, given a rolling speed of 100 m per second and a length of the soaking section 13 of 70 m, there is in the soaking section 13, for a specific rolled-material diameter, temperature equalization starting from a temperature difference of 300° C. at the end of the water cooling section 5 to a temperature difference of about 10° C.

The required pass temperature for the finishing block 4 can be set by the water cooling section 5 arranged downstream of the roughing block 2 as a function of the predefined material characteristics, such as structure, grain size, strength, ductility, distribution of inclusions, etc., to a specific value, for example to 750° C. If the pass temperature of the finishing block is higher, cooling down to the necessary laying temperature can be achieved by means of the water cooling section 19 which is arranged downstream of the finishing block 4. This is of great significance, above all in the case of an exit temperature from the finishing block 4 in the range of 900° C.

The rolling-mill installation according to the invention has the following advantages:

Thermomechanical rolling is possible for a large diameter range or cross-sectional range of the rolled material 1.

A very long soaking section 13 with optimum temperature equalization is made possible, but nevertheless the overall installation has only the length of an installation for conventional rolling.

Changing over from conventional rolling to thermomechanical rolling or vice versa can be carried out within minutes without complicated conversion work.

The installation has a simple construction, and the individual units can be incorporated and removed quickly.

Overall, the installation has an extremely high flexibility.

What is claimed is:

1. A rolling mill installation for continuous production of fine steel comprising:

a roughing block through which the steel passes on a rolling line;

a finishing block disposed on the rolling line after the roughing block;

a water cooling section on the rolling line after the finishing block;

a rolled material diverter after the water cooling section, the diverter including elements for optionally diverting the rolled material on one of a first and a second path;

a laying unit after the diverter and the first path of the diverter routing the steel to the laying unit;

a soaking section after the diverter and on the second path, the soaking section being for soaking the steel; the second path leading back to the finishing block and passing the steel through the finishing block;

the finishing block being movable between a first and a second position, wherein in the first position, the finishing block is on the rolling line from the roughing block and the fine steel from the roughing block passes the finishing block to the cooling section along the first path, and in the second position, the finishing block is on the second path, so that the steel on the second path is led back to and passes the finishing block.

2. The rolling mill installation of claim 1, wherein after the finishing block, the second path continues to the diverter.

3. The rolling mill installation of claim 1, wherein the finishing block is movable between the first and second positions thereof by parallel displacement thereof.

4. The rolling mill installation of claim 1, wherein the finishing block is movable between the first and second positions thereof by movement of the finishing block to one side.

5. The rolling mill installation of claim 4, wherein the movement of the finishing block is to one side of the rolling line comprises pivoting of the finishing block.

6. The rolling mill installation of claim 2, further comprising a water cooling section for the fine steel located on the second path after the finishing block, and the water cooling section being oriented in the direction of the laying unit.

7. The rolling mill installation of claim 1, further comprising a water cooling section for the fine steel located on the second path after the finishing block, and the water cooling section being oriented in the direction of the laying unit.

8. The rolling mill installation of claim 1, further comprising the soaking section having a first approximately semicircular curved part after the diverter and a second approximately semicircularly curved part before the finishing block.

9. The rolling mill installation of claim 8, further comprising a rectilinear part of the soaking section joining the semicircular parts.

10. The rolling mill installation of claim 8, further comprising at least one driver on the second path located before the fine steel enters the soaking section and a second driver on the second path located near to the end of the soaking section and before the finishing block.

11. The rolling mill installation of claim 8, further comprising a first driver on the second path located before the soaking section and in the area of the diverter; a second straightening driver on the second path after the first semicircular curved part of the soaking section and after the diverter; and a third driver on the second path located before the second curved part of the soaking section.

12. The rolling mill installation of claim 8, wherein the second curved part of the soaking section opens flush into the finishing block on the second path.

13. The rolling mill installation of claim 9, wherein the rectilinear part of the soaking section extends approximately parallel to the water cooling section arranged on the rolling line of the roughing block.

14. The rolling mill installation of claim 1, wherein the soaking section has a main part that extends approximately parallel to the water cooling section arranged on the rolling line of the roughing block.

15. The rolling mill installation of claim 1, wherein the first position of the diverter is for conventional steel rolling and the diverter includes a first guide which is oriented from the rolling line at the roughing block to the laying unit; the second position of the diverter includes a second guide which is oriented to divert the steel off the rolling line of the roughing block and toward the soaking section; the first and second guides being offset such that one of them at a time acts on the fine steel moving toward the laying unit and the first guide operates with the finishing block in the first position and the second guide operates with the finishing block in the second position.

16. The rolling mill installation of claim 15, wherein the first and second guides are offset vertically and the movement of the finishing block is vertical.

* * * * *